US009975349B2

(12) United States Patent
Ellis

(10) Patent No.: US 9,975,349 B2
(45) Date of Patent: May 22, 2018

(54) PRINTING

(71) Applicant: VIDEOJET TECHNOLOGIES INC., Wood Dale, IL (US)

(72) Inventor: Jeremy Ellis, Notingham (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days. days.

(21) Appl. No.: 14/901,879

(22) PCT Filed: Oct. 16, 2014

(86) PCT No.: PCT/GB2014/053105

§ 371 (c)(1),
(2) Date: Dec. 29, 2015

(87) PCT Pub. No.: WO2015/056016

PCT Pub. Date: Apr. 23, 2015

(65) Prior Publication Data

US 2016/0159103 A1 Jun. 9, 2016

(30) Foreign Application Priority Data

Oct. 18, 2013 (GB) ..... 1318444.5

(51) Int. Cl.
*B41J 2/35* (2006.01)
*B41J 2/355* (2006.01)
*B41J 2/375* (2006.01)

(52) U.S. Cl.
CPC ..... *B41J 2/355* (2013.01); *B41J 2/375* (2013.01)

(58) Field of Classification Search
None
See application file for complete search history.

(56) References Cited

U.S. PATENT DOCUMENTS 4,563,691 A * 1/1986 Noguchi ..... B41J 2/35 347/190
4,656,489 A * 4/1987 Sato ..... B41J 2/35 347/182
4,887,092 A * 12/1989 Pekruhn ..... B41J 2/365 219/484
5,784,092 A * 7/1998 Fukuoka ..... B41J 2/36 347/190
2011/0229239 A1* 9/2011 Lakin ..... B41J 33/14 400/234
2013/0215210 A1* 8/2013 McNestry ..... B41J 35/36 347/214

* cited by examiner

*Primary Examiner* — Matthew Luu
*Assistant Examiner* — Tracey McMillion
(74) *Attorney, Agent, or Firm* — Robert L. Wolter; Beusse, Wolter, Sanks & Maire PLLC

(57) ABSTRACT

A method for controlling a thermal printhead of a printer. The printhead comprises an array of printing elements. The method may comprise performing a plurality of printing operations, each printing operation comprising energization of one or more printing elements. A respective energization value is determined for each printing element based upon energizations of that printing element during said printing operations. A printhead control signal is generated for the printhead for a subsequent printing operation based upon the energization values of a predetermined subset of the printing elements.

20 Claims, 6 Drawing Sheets

Cont_1

Cont_2

Cont_3

Cont_4

Cont_5

PRINTING

The present invention relates to printing and more particularly to a method for controlling a thermal printhead of a thermal printer.

Thermal transfer printers use an ink carrying ribbon. In a printing operation, ink carried on the ribbon is transferred to a substrate which is to be printed. To effect the transfer of ink, the printhead is brought into contact with the ribbon, and the ribbon is brought into contact with the substrate. The printhead contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

The printing elements are generally arranged in a linear array. By causing relative movement between the printhead and the substrate on which printing is to occur, an image can be printed by carrying out a series of printing operations, each printing operation comprising the energisation of none, some or all of the printing elements to print a 'line' of the desired image before the relative movement is caused. A further 'line' is then printed in a next printing operation. A plurality of lines printed in this way together form the whole of the desired image.

Where a printing element is energised during a number of adjacent printing operations, that printing element may become hot so as to overheat. Overheating printing elements can degrade print quality. It is therefore desirable to limit energisation times of printing elements in a particular printing operation which may retain heat from a previous printing operation. To this end some printheads include circuitry intended to monitor energisation of individual printing elements and limit energisation times based upon the monitored energisation.

While the incorporation of such circuitry in thermal printheads allows for improved print quality, further improvements are required so as to ensure that high quality print can be achieved in all printing circumstances.

It is an object of some embodiments of the invention to provide a novel control method for a thermal printhead which obviates or mitigates some of the problems outlined above.

According to a first aspect of the invention, there is provided a method for controlling a thermal printhead of a printer, the printhead comprising an array of printing elements, the method comprising: performing a plurality of printing operations, each printing operation comprising energisation of one or more printing elements; determining, for each printing element, a respective energisation value based upon energisations of that printing element during said printing operations; and generating a printhead control signal for the printhead for a subsequent printing operation based upon the energisation values of a predetermined subset of the printing elements.

The first aspect of the invention therefore processes data indicating energisations of printing elements in a predetermined subset of the printing elements during a plurality of printing operations and uses these values to generate a printhead control signal which is used in a subsequent printing operation.

Where the printhead comprises an array of printing elements each printing operation may comprise providing data for each printing element in the array indicating whether that printing element should be energised in that printing operation. Where the printhead comprises a one-dimensional linear array of printing elements, each printing operation may print a 'line' of a printed image.

The predetermined subset of the printing elements may be a subset of spatially adjacent printing elements. In this way the effects of one printing element on other spatially adjacent printing elements may be taken into account by the processing of the energisation values.

The printhead control signal may affect energisation of a plurality of the printing elements in the subsequent printing operation. For example the printhead control signal may affect all printing elements in the predetermined subset or all printing elements of the printhead. The printhead control signal may affect energisation of the plurality of the printing elements in the same way.

Each energisation value may be a number, for example a real number or an integer.

Generating the printhead control signal may comprise generating a first printhead control signal if said energisation values of the predetermined subset of printing elements satisfy the predetermined criterion and generating a second printhead control signal if said predetermined subset of printing elements do not satisfy the predetermined criterion.

The printhead control signal may affect energy dissipated by one or more printing elements in the subsequent printing operation. In this way the method provides for the processing of energisation values based upon energisations of printing elements in printing operations which precede the subsequent printing operation and uses this processing to affect the energy dissipated in a subsequent printing operation. For example, where the processing of the energisation values indicates that all the processed energisation values exceed some predetermined threshold the printhead control signal may be arranged to reduce the energy dissipated by printing elements in the subsequent printing operation, thereby taking advantage of heat retained in printing elements from previous printing operations and avoiding overheating of printing elements.

Generating the printhead control signal may comprise generating one or more timing signals controlling one or more times for which printing elements are energised in said subsequent printing operation. For example, where the processing of the energisation values indicates that the printing elements in the predetermined subset have been much energised in the preceding printing operations the energisation time(s) to be used in the subsequent printing operation may be reduced.

Determining an energisation value for a respective one of said printing elements may comprise summing a plurality of energy values, each energy value being associated with one of said plurality of printing operations. Each of said energy values may be based upon whether the respective printing element is energised in said associated printing operation. Each of said energy values may additionally or alternatively be based upon whether the respective printing element was energised in a printing operation preceding said associated printing operation.

Each of said energy values may take a value having a first sign if the respective printing element is energised in the associated printing operation, and a value having a second sign if the respective printing element is not energised in the associated printing operation. For example, the energy values may be positive where the printing element was energised in the associated printing operation and negative where the printing element was not energised in the associated printing operation.

The energisation value for each printing element may be generated based upon printing operations carried out to print part of a single image. That is, each energisation value may be a sum of a plurality of energy values, there being one energy value for each 'line' of a printed image which has been printed at the time at which the energisation values are processed. The energisation value for each printing element may be reset when the printing of a new image begins.

The printhead control signal may be generated based upon whether the energisation values of the predetermined subset of printing elements satisfy a predetermined criterion.

The criterion may be specified based upon a relationship between one or more energisation values and a threshold value. The criterion may be satisfied if each of said energisation value satisfies an energisation value criterion. Alternatively, the criterion may be satisfied if said energisation values taken together satisfy an energisation value criterion. Alternatively the criterion may be satisfied if a predetermined proportion of printing elements satisfy an energisation value criterion.

The method may be carried out at a printer controller external of the printhead. The printhead may further implement a method arranged to control the energy dissipated by printing elements in a printing operation.

The printhead may comprise a printhead controller and the method may further comprise, at the printhead controller, for each of a plurality of printing elements to be energised, determining a printing element control signal based upon energisation of one or more printing elements in a printing operation which precedes the subsequent printing operation.

The printing element control signal for a respective printing element may be determined based upon energisation of the respective printing element in one or more preceding printing operations. Additionally, the printing element control signal for a respective printing element may be further determined based upon energisation of one or more spatially adjacent printing elements in one or more preceding printing operations.

The printing element control signal for a respective printing element may be generated based upon a first number of printing operations which precede the subsequent printing operation. The printhead control signal may be generated based upon a second number of printing operations which precede the subsequent printing operation. The second number of printing operations may be greater than the first number of printing operations, thereby allowing control over two time periods to be affected.

Determining a printing element control signal may comprise determining a time for which the printing element is to be energised in the subsequent printing operation. Determining the time for which the printing element is to be energised in the subsequent printing operation may comprise selecting one of a plurality of times for which the printing element should be energised in the subsequent printing operation. The plurality of times may be specified by said printhead control signal.

Generating the printhead control signal based upon the energisation values of the predetermined subset of printing elements may comprise: obtaining first data indicating a relationship between a first energisation value and a first printhead control signal; processing said first data and said energisation values of the predetermined subset of printing elements to generate said printhead control signal.

The first data may, for example, define an optimal value for the printhead control signal for the first energisation value. Generating the printhead control signal based upon said first data allows a printhead control signal to be adjusted to achieve an improved printing performance.

The method may further comprise obtaining second data indicating a relationship between a second energisation value and a second printhead control signal; wherein processing said first data and said energisation values of the predetermined subset of printing elements comprises processing said second data such that said generated printhead control signal is based upon said first data and said second data.

The first and second data may, for example, define first and second energisation values at which there are optimal respective first and second printhead control signals. Where the energisation value of the predetermined subset of printing elements is between the first and second energisation values, the printhead control signal may be generated so as to be between the first and second printhead control signals, for example by interpolating between the first and second printhead control signals and first and second energisation values. Such a generation of the printhead control signal allows an optimal printhead control signal to be generated for any energisation value based upon a sparse set of optimal printhead control signals.

Said processing said first data, said second data and said energisation values of the predetermined subset of printing elements may comprise: determining a relationship between said first energisation value, said second energisation value and said energisation values of the predetermined subset of printing elements; and generating said printhead control signal based upon the first printhead control signal and the second printhead control signal according to the determined relationship.

Generating a printhead control signal based upon the energisation values of a predetermined subset of the printing elements may comprise: determining a difference between the energisation values of the predetermined subset of the printing elements and a threshold value; and generating the printhead control signal based upon said determined difference.

By using the difference between the energisation values of the predetermined subset of the printing elements and a threshold value it is possible to generate an optimal printhead control signal. For example, by applying an adjustment factor to a nominal printhead control signal which is proportional to the difference between the energisation values of the predetermined subset of the printing elements and a threshold value, a known relationship between printhead control signals and the energisation values can be brought about, allowing an improved control over the energy delivered to a printhead during each printing operation.

According to a second aspect of the present invention, there is provided a method for controlling a thermal printhead of a printer, the printhead comprising an array of printing elements, the method comprising: performing first processing in a printer controller external of the printhead, the first processing being arranged to control the dissipation of energy from printing elements during a printing operation based upon one or more previous printing operations; and performing second processing in a printhead controller of the printhead, the second processing being arranged to further control the dissipation of energy from printing elements during a printing operation.

In this way the first and second processing work together to control the dissipation of energy (e.g. heat energy) from printing elements during a printing operation. The second processing is performed at a printhead controller. Such a controller may be defined and specified by a manufacturer of the printhead. A manufacturer of the printer making use of the printhead may therefore have no control over the second processing. In such a case the use of first processing alongside the second processing provides a printer manufacturer with effective control of the energy dissipated by printing elements through specification of the first processing which is carried out within a printer controller which is external to the printhead but which may be internal to the printer.

The first processing may provide a signal to the printhead controller which commonly affects the dissipation of energy from a plurality of said printing elements. That is a plurality of the printing elements (being some or all of the printing elements) may be affected in the same way by the signal generated by the first processing.

The second processing may control the dissipation of energy individually for each printing element. That is, relatively coarse grained control may be provided by the first processing at the printer controller (affecting a plurality of printing elements in the same way) and relatively fine grained control may be provided by the second processing at the printhead controller (affecting each printing element individually).

The first processing may be arranged to provide a plurality of signals to the printhead controller and the second processing may be arranged to select one of the plurality of signals to control dissipation of energy during a printing operation. For example, the second processing at the printhead controller may be arranged to select a particular one of the plurality of signals for each printing element on a per-printing element basis.

The first processing may be arranged to generate the plurality of signals based upon energisation of printing elements in one or more printing operations. For example, the first processing may be arranged to generate the plurality of control signals based upon data indicative of energy dissipation in preceding printing operations.

At least one of the first processing and the second processing may control the dissipation of energy during a printing operation by controlling a time for which one or more printing elements are energised. For example the first processing may generate a plurality of time values which are provided to the printhead controller and the second processing at the printhead controller may then select a particular one of the time values to be used for energisation of each of the printing elements.

Features discussed above in the context of the first aspect of the invention can be applied to the second aspect of the invention. In particular the first processing may be arranged to generate energisation values of the type discussed in the context of the first aspect of the invention.

The invention further provides a thermal printer controller comprising circuitry arranged to control a thermal printer to carry out a method as described above. The circuitry may comprise a memory storing processor readable instructions and a processor configured to read and execute instructions stored in said memory, the instructions being arranged to carry out the method described above.

A further aspect of the invention provides a thermal transfer printer comprising: first and second spool supports each being configured to support a spool of ribbon; and a ribbon drive configured to cause movement of ribbon from the first spool support to the second spool support; a printhead configured to selectively transfer ink from the ribbon to a substrate, and a controller of the type described in the preceding paragraph.

The invention also provides a thermal printer in which the printhead is arranged such that its constituent printing elements cause a thermally sensitive substrate to be heated.

The methods described above can be implemented in any convenient form. As such the invention also provides computer programs which can be executed by a processor of a thermal printer so as to cause a printhead of the thermal printer to be controlled in the manner described above. Such computer programs can be stored on computer readable media such as non-tangible, not transitory computer readable media.

Embodiments of the invention are now described, by way of example, with reference to the accompanying drawings, in which.

Figure 1:
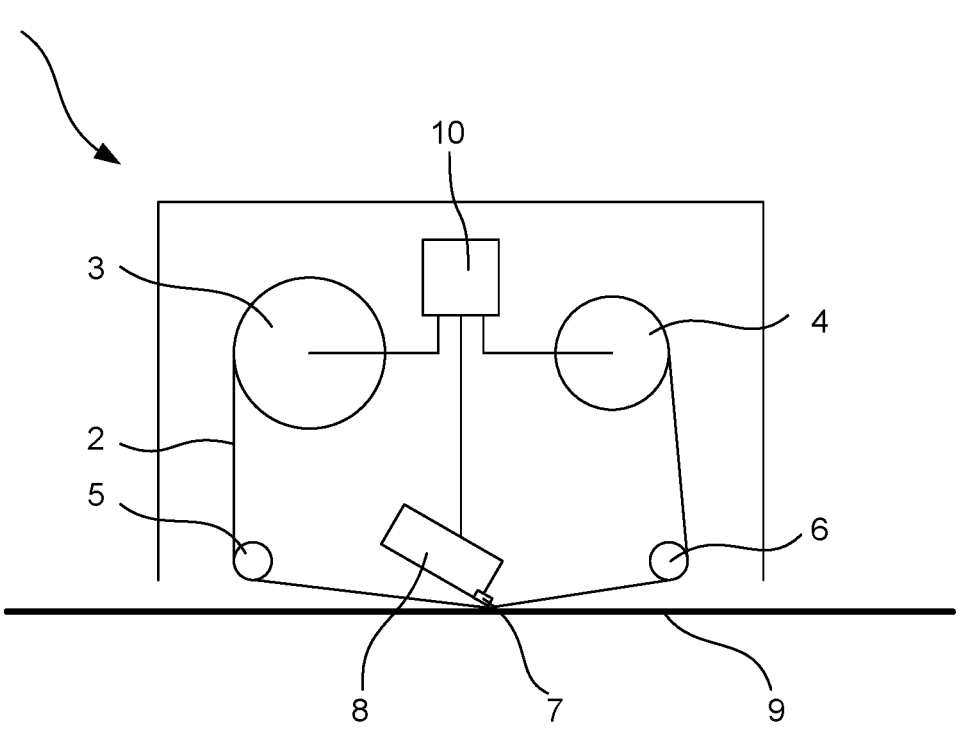
FIG. 1 is a schematic illustration of a thermal transfer printer in which embodiments of the invention may be implemented.

Referring to FIG. 1, a thermal transfer printer 1 comprises an ink carrying ribbon 2 which extends between two spools, a supply spool 3 and a takeup spool 4. In use, ribbon 2 is transferred from the supply spool 3 to the takeup spool 4 around rollers 5, 6, past a thermal printhead 7. The rollers 5, 6 may be idler rollers, and serve to guide the ribbon 2 along a predetermined path. The printhead 7 is mounted on a printhead carriage 8. The ribbon 2 is driven between the supply spool 3 and the takeup spool 4 under the control of a printer controller 10. The ribbon 2 may be transported between the supply spool 3 and the takeup spool 4 in any convenient way. One method for transferring ribbon is described in our earlier patent, U.S. Pat. No. 7,150,572, the contents which are herein incorporated by reference.

In a printing operation, ink carried on the ribbon 2 is transferred to a substrate 9 which is to be printed on. To effect the transfer of ink, the print head 7 is brought into contact with the ribbon 2. The ribbon 2 is also brought into contact with the substrate 9. The printhead 7 may be caused to move towards the ribbon 2 by movement of the printhead carriage 8, under control of the printer controller 10. The printhead 7 comprises printing elements 11 arranged in a one-dimensional linear array, which, when heated, whilst in contact with the ribbon 2, cause ink to be transferred from the ribbon 2 and onto the substrate 9. Ink will be transferred from regions of the ribbon 2 which correspond to (i.e. are aligned with) printing elements 11 which are heated. The array of printing elements 11 can be used to effect printing of an image on a substrate by selectively heating printing elements 11 which correspond to regions of the image which require ink to be transferred, and not heating printing elements 11 which require no ink to be transferred. Printing elements and regions of the printed image may be referred to as pixels.

A two dimensional image may be printed by printing a series of lines, the printing of each line being referred to as a printing operation. Different printing elements within the array may be heated during the printing of each line (i.e. during each printing operation). Between the printing of each line, the printhead 7, ribbon 2, and substrate 9 are moved with respect to each other, such that the line printed on the substrate 9 from one printing operation is adjacent to the line printed by the next printing operation. In some embodiments this is achieved by moving the printhead 7 relative to the ribbon 2 and substrate 9 which remain stationary, while in other embodiments this is achieved by holding the printhead 7 stationary and moving the ribbon 2 and substrate 9 relative to the printhead 7.

A barcode may be printed on a substrate by printing multiple lines, each of which provides a cross section of the whole barcode. Alternatively, where the barcode is printed in an orientation whereby bars of the barcode run generally parallel to the linear array of printing elements, each printing operation will print part of a bar of the barcode or else correspond to white space between adjacent bars of the bar code. Barcodes which are printed in such a way that bars of the barcode are generally parallel to the linear array of printing elements are referred to as 'ladder barcodes'. The inventors have discovered that print quality of ladder barcodes is particularly susceptible to overheating of printing elements. The techniques described herein are intended to avoid printhead overheating. As such, the described techniques are useful in improving the print quality of ladder barcodes which is important given that barcodes are, of course, intend to be scanned by a scanning device and degradation of print quality can have an adverse impact on the accuracy with which barcodes can be read. That said, it will be appreciated that the techniques described herein are generally applicable and can be used to improve print quality of any image, particularly but not exclusively images including sizeable portions of continuous print (i.e. large 'black' areas).

In one embodiment, the printhead 7 comprises a one-dimensional linear array of 1280 printing elements 11. Each printing element 11 comprises a heating element and a switching arrangement capable of determining whether that printing element is energised in a particular printing operation.

Figure 2:
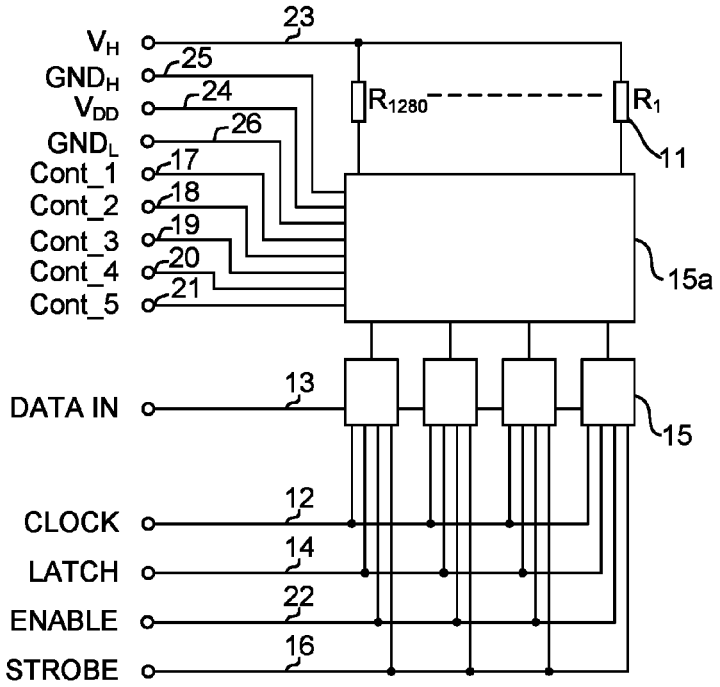
FIG. 2 is a schematic illustration of thermal printhead connections in the printer of FIG. 1.

Referring to FIG. 2, the printhead 7 is illustrated. For ease of understanding only two printing elements are illustrated, being one printing element at a first end of the one-dimensional linear array and one printing element at a second end of the one-dimensional linear array. It will be appreciated that the intermediate printing elements which are not shown in FIG. 2 take similar form and are similarly controlled. FIG. 2 also shows various printhead connections which are connected to and controlled by the printer controller 10.

Figure 3:
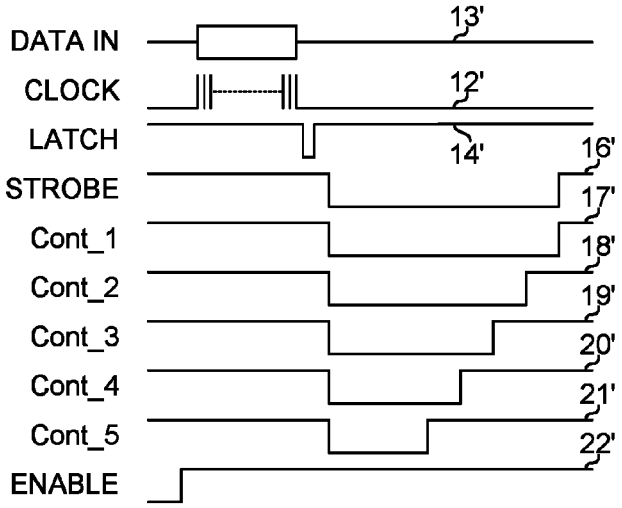
FIG. 3 is timing diagram showing signals provided on the connections of FIG. 2.

FIG. 3 is a timing diagram showing signals provided on the various printhead connections shown in FIG. 2 by the printer controller 10 to effect printing. The connections shown in FIG. 2 and the signals provided on those connections as shown in FIG. 3 are now described together.

A clock signal 12' is provided on a clock line 12. Data 13' is provided on a data line 13 as serial binary data having 1280 bits, each bit of the data indicating whether a respective one of the 1280 printing elements is to be energised in a printing operation. In one embodiment a '1' or high signal indicates that a respective printing element should be energised while a '0' or low signal indicates that the respective printing element should not be energised. The data line passes through registers provided by printing element controllers 15 which together provide a shift register. When 1280 bits of data have been received, a low latch signal 14' on an active-low latch line 14 causes the received data to be transferred from the registers provided by the printing element controllers 15 to control logic within the printing element controllers 15. The printing element controllers 15 can each control a single printing element or alternatively, as is the case in the described embodiment, a single printing element controller can control a plurality of printing elements. In the described embodiment the four printing element controllers 15 each control 320 printing elements, and therefore each receive 320 bits of data when the low latch signal 14' is provided on the latch line 14, each bit of data indicating whether one of the printing elements under the control of that printing element controller 15 should be energised.

During a printing operation a strobe signal 16' on an active-low strobe line 16 causes printing elements 11 to be energised. The duration of energisation is determined by the respective printing element controller 15 by selecting one of five active-low timing signals 17', 18', 19', 20', 21' respectively provided on a Cont_1 line 17, a Cont_2 line 18, a Cont_3 line 19, a Cont_4 line 20 and a Cont_5 line 21, the selected timing signal indicating the time for which a respective printing element should be energised. In this way the printing element controllers 15 can energise different ones of the printing elements 11 for different periods of time.

The printhead comprises an active-high enable line 22 on which a high signal 22' is provided for the duration of a printing operation.

In addition to the control signals described above the printhead also has two voltage connections 23, 24. A first voltage connection 23 provides a voltage supply to the printing elements 11. For example, the first voltage connection may be connected to a voltage of 24 volts. A second voltage connection 24 provides a voltage supply to the printing element controllers 15 and other elements of control logic within the printhead. Each of the first and second voltage connections 23, 24 is provided with a respective ground connection, a first ground connection 25 being associated with the first voltage connection 23 and a second ground connection 26 being associated with the second voltage connection 24.

The printhead further comprises control logic 15*a* to which are connected the control signals 17, 18, 19, 20, 21 and connections 24, 25, 26. The control logic 15*a* is connected by connections to the printing element controllers 15.

In operation, the printing element controllers 15 select a time for which a particular printing element should be energised by selecting between the timing signals provided on the lines 17, 18, 19, 20, 21. This selection is now described with reference to FIGS. 4A to 4E.

Where a printing element controller 15 is selecting an energisation time for a printing element A in a printing operation $P_n$, the printing element controller 15 has regard to energisation of the printing element A in the two immediately preceding printing operations $P_{n-1}$ and $P_{n-2}$. The printing element controller 15 also has regard to the energisation of spatially adjacent printing elements B, C in the immediately preceding printing operation $P_{n-1}$. Depending upon the energisations of the printing elements A, B, C in this way one of the timing signals 17', 18', 19', 20', 21' is selected.

FIGS. 4A to 4E all have common form. A three by three grid comprises one column for each of printing elements A, B, C as labelled. A central row labelled $P_{n-1}$ indicates whether the respective printing elements were energised in printing operation $P_{n-1}$. A top row labelled $P_{n-2}$ indicates whether the respective printing elements were energised in the printing cycle $P_{n-2}$. Where a cross appears in a cell of the grid this indicates that the respective printing element was energised in the respective printing operation. Where a hollow circle appears in a cell of the grid this indicates that the respective printing element was not energised in the respective printing operation.

A bottom row of each grid relates to printing operation $P_n$, that being the printing operation for which the energisation time for the printing element A is being determined.

Figure 4A:
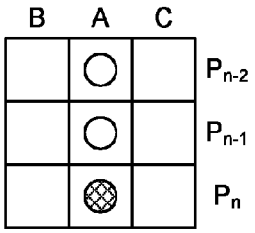
FIGS. 4A to 4E are schematic illustrations of an energy control scheme implemented in the printhead of FIG. 2.

Referring first to FIG. 4A this indicates the pattern of energisations required to cause selection of the Cont_1 timing signal 17' provided on the Cont_1 line 17 for energisation of the printing element A in the printing operation $P_n$. This requires that in each of the printing operations $P_{n-1}$ and $P_{n-2}$ the printing element A was not energised. The Cont_1 signal is selected in this circumstance regardless of the energisation of the printing elements B, C in the printing operation $P_{n-1}$.

Figure 4B:
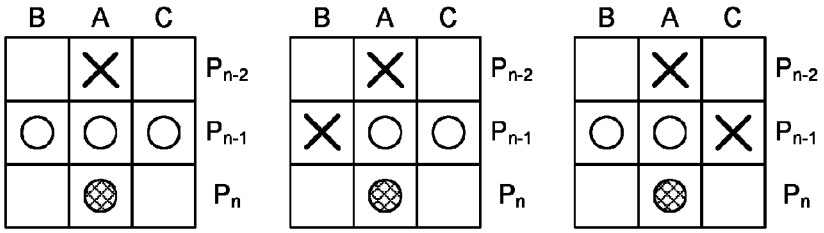

Referring to FIG. 4B, this indicates the pattern of energisations required to cause selection of the Cont_2 timing signal 18' provided on the Cont_2 line 18 for energisation of the printing element A in the printing operation $P_n$. Here, the requirement is that the printing element A was not energised in the printing operation $P_{n-1}$, that the printing element A was energised in the printing operation $P_{n-2}$, and that no more than one of the printing elements B, C was energised in the printing operation $P_{n-1}$.

Figure 4C:
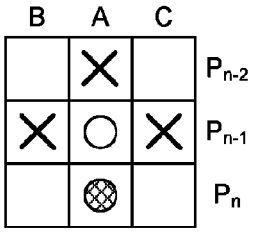

Referring to FIG. 4C, this indicates the pattern of energisations required to cause selection of the Cont_3 timing signal 19' provided on the Cont_3 line 19 for energisation of the printing element A in the printing operation $P_n$. Here, the requirement is that the printing element A was not energised in the printing operation $P_{n-1}$, that the printing element A was energised in the printing operation $P_{n-2}$, and that both of the printing elements B, C were energised in the printing operation $P_{n-1}$.

Figure 4D:
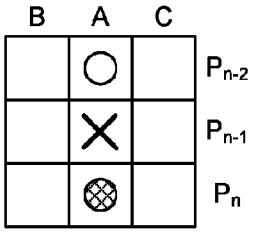

Referring to FIG. 4D, this indicates the pattern of energisations required to cause selection of the Cont_4 timing signal 20' provided on the Cont_4 line 20 for energisation of the printing element A in the printing operation $P_n$. Here, the requirement is that the printing element A was energised in the printing operation $P_{n-1}$, but was not energised in the printing operation $P_{n-2}$, regardless of the energisation of the printing elements B, C in the printing operation $P_{n-1}$.

Figure 4E:
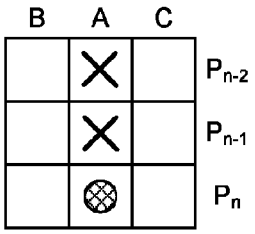

Referring to FIG. 4E, this indicates the pattern of energisations required to cause selection of the Cont_5 timing signal 21' provided on the Cont_5 line 21 for energisation of the printing element A in the printing operation $P_n$. Here, the requirement is that the printing element A was energised in the printing operation Pn−1, and was energised in the printing operation $P_{n-2}$, regardless of the energisation of the printing elements B, C in the printing operation $P_{n-1}$.

Referring back to FIG. 3 it can be seen that the time specified by the Cont_5 Signal 21' is the shortest of the timing signals while the Cont_1 signal 17' is the longest and the other timing signals form a range therebetween. From FIGS. 4A to 4E it can be seen that the Cont_5 signal 21' is selected when the printing element A has been energised in each of the immediately preceding printing operations. It can therefore be expected that in such a circumstance the printing element A will already be relatively hot thereby making a short energisation time, as specified by the Cont_5 signal 21', appropriate. Conversely, where the printing element A has not be energised in either of the immediately preceding operations it can be seen that the Cont_1 signal 17' is selected which will cause the relatively cool printing element to be heated for a relatively long time. Indeed, taken together, the illustrations of FIGS. 4A to 4E cause the time of energisation to be relatively long where the printing element A is relatively cool and relatively short where the printing element A is relatively hot.

As indicated above, the printer controller 10 controls the timing signals 17', 18', 19', 20', 21'. Processing carried out to determine the timing signals is described below. It can be noted, however, that in some embodiments the printer controller 10 may determine that two or more of the timing signals 17', 18', 19', 20', 21' should have the same value. In one embodiment the printer controller 10 is arranged to provide a signal on the Cont_1 line 17 which is of equal duration to the strobe signal 16'. This represents energisation of printing elements for a maximum possible time when the Cont_1 signal 17' is selected by one of the printing element controllers 15. Shorter timing signals of equal length are provided on the Cont_2 line 18 and Cont_3 line 19. A still shorter timing signal is provided on the Cont_4 line 20 and a shorter still timing signal is provided on the Cont_5 line 21. In one embodiment the Cont_1 signal 1 17' has a duration of 0.289 ms, while the Cont_5 signal has a duration of 0.126 ms.

The printer controller 10 is responsible for generating the data signal 12' provided to the printhead on the data line 12. This indicates whether each printing element is energised in each printing operation. Based upon this data, the printer controller maintains an energisation value for each printing element and uses these energisation values to determine the times specified by each of the timing signals 17', 18', 19', 20', 21'.

Figure 5:
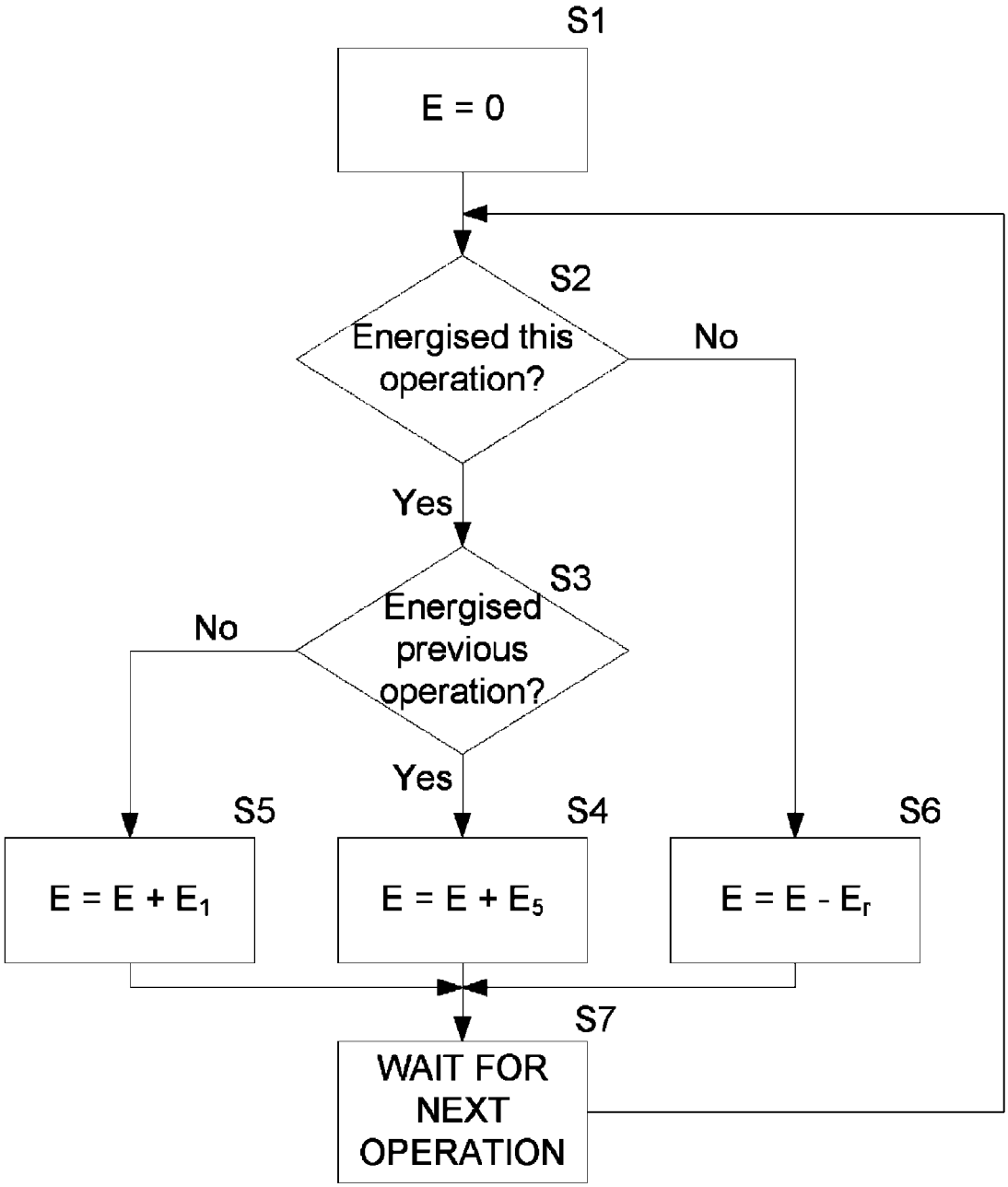
FIG. 5 is a flowchart showing processing carried out in a printer controller to generate energisation values for printing elements.

In more detail, FIG. 5 shows the generation of an energisation value for a single printing element. At step S1 the energisation value is initialised to 0. At step S2 a check is carried out to determine whether the printing element is energised in the current printing operation. If it is determined that the printing element is energised in the current printing operation, processing passes to step S3 where a check is carried out to determine whether the printing element was energised in the immediately preceding printing operation. If it is determined at step S3 that the printing element was also energised in the immediately preceding printing operation (it having been determined that the printing element was energised in the current printing operation at step S2), processing passes to step S4 where the energisation value is increased by an energy value $E_5$. In one embodiment the energy value $E_5$ has a value of 4. If, however at step S3 it is determined that the printing element was not energised in the immediately preceding printing operation, processing passes step S5 where the energisation value is increased by an energy value $E_1$, the energy value $E_1$ being larger than the energy value $E_5$. For example, in one embodiment the energy value $E_1$ has a value of 9.

If, however it is determined at step S2 that the printing element was not energised in the current printing operation, processing passes to step S6 where the energisation value is reduced by an energy value $E_r$. In one embodiment the energy value $E_r$ has a value of 3.

Processing passes from each of steps S4, S5 and S6 to step S7 where processing waits for a next printing operation before returning to step S2.

The processing of FIG. 5 therefore provides a method for generating and updating an energisation value for a particular printing element during a plurality of printing operations, for example a plurality of printing operations corresponding to a single image. The value of the energisation value for each printing element is reset to zero after the printing of a particular image. That is, each energisation value is an indication of energisation of a particular printing element during the printing of a particular image.

Figure 6:
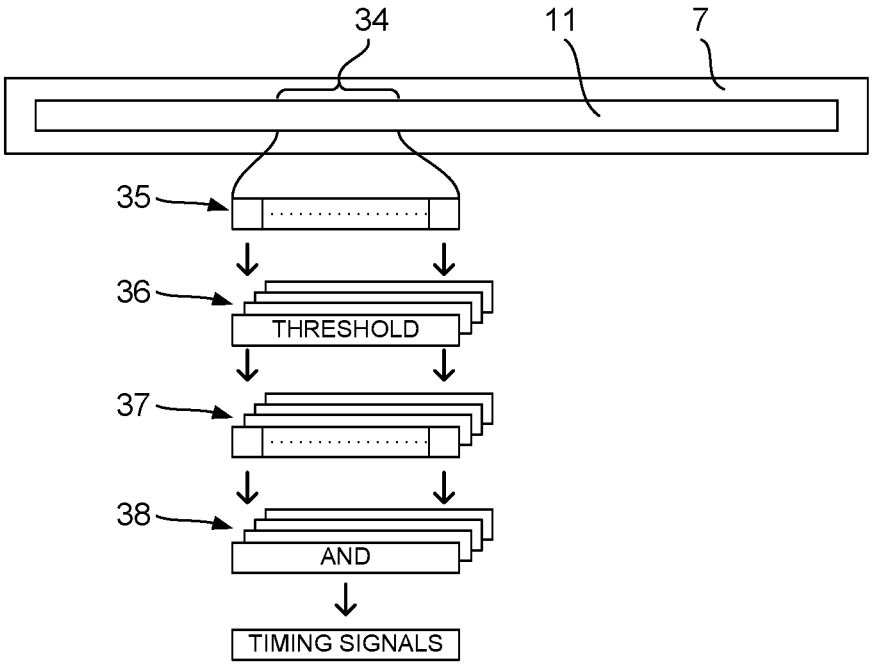
FIG. 6 is a schematic illustration showing the way in which the energisation values are processed.

FIG. 6 shows how a plurality of energisation values are processed. FIG. 6 shows the printing elements 11 of the printhead 7. A spatially adjacent subset 34 of the printing elements 11 is selected for processing, there being an energisation value 35 for each printing element 11 in the spatially adjacent subset 34. The subset may, for example, comprise 32 printing elements. Each of the energisation values 35 is processed with respect to each of a plurality of thresholds 36, to generate a plurality of data sets 37, each data set 37 comprising one data item for each printing element 11 in the spatially adjacent subset 34 of printing elements. In each data set 37, each of the data items indicates whether its corresponding energisation value 35 exceeds a particular one of the thresholds 36. Each of the data sets 37 is processed by a block 38 and if it is determined that each of the data items in a particular data set 37 indicates that its respective energisation value exceeds the respective threshold 36, the durations of the timing signals 17', 18', 19', 20,' 21' are reduced, thereby causing the printing elements to dissipate less energy in subsequent printing cycles.

In one embodiment, where a plurality of thresholds are applied a first threshold has a value of 400, and a second threshold has a value of 650. If the energisation values 35 of all of the printing elements 11 in the spatially adjacent subset 34 exceed the first threshold, the timing signals 17', 18', 19', 20', 21' are all reduced to 95% of their maximum value. However, if the energisation values 35 of all of the printing elements 11 in the spatially adjacent subset 34 exceed the second threshold, the timing signals 17', 18', 19', 20', 21' are all reduced to 85% of their maximum value. It will be appreciated that any number of thresholds may be used. For example third and fourth thresholds having values greater than 650 may be applied. Where the energisation values 35 of all of the printing elements 11 in the spatially adjacent subset 34 exceed the third threshold the timing signals may be reduced to 75% of their maximum value. Where the energisation values 35 of all of the printing elements 11 in the spatially adjacent subset 34 exceed the fourth threshold the timing signals may be reduced to 65% of their maximum value. It will be appreciated that in some implementations only some of the timing signals 17', 18', 19', 20', 21' may be modified by the processing of FIG. 6.

Figure 7:
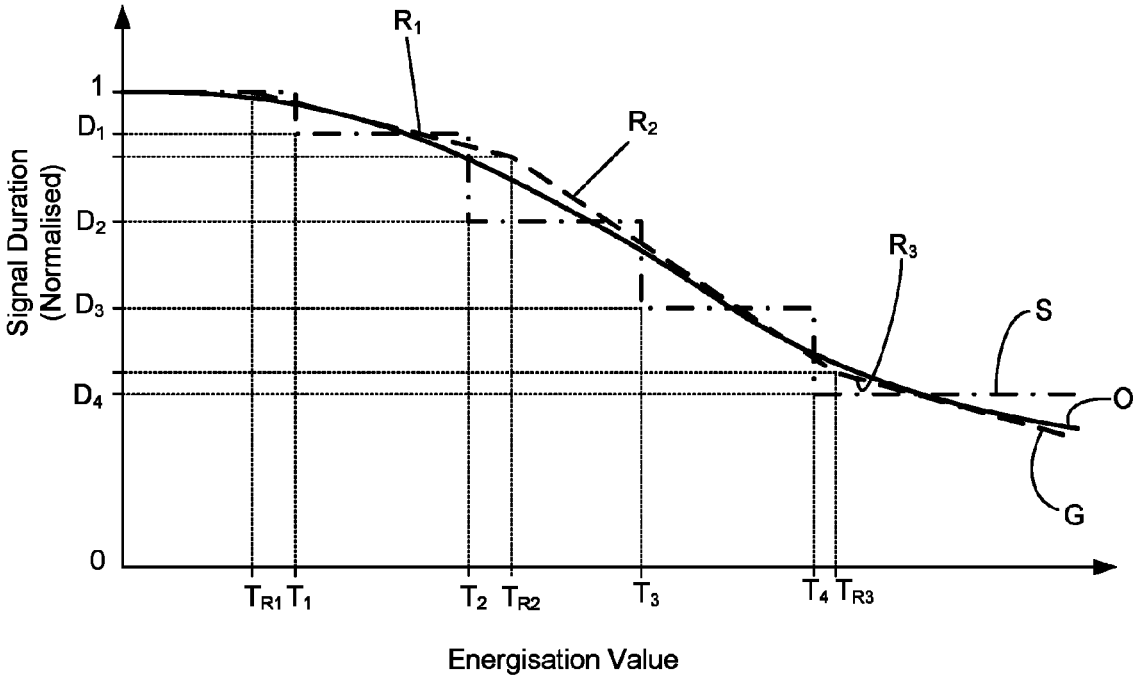
FIG. 7 is an illustration of a relationship between the printing element control signals and energisation values.

FIG. 7 illustrates a relationship between the energisation value and a printhead timing signal. It will be appreciated that for each printing operation there will be an optimal printing energy and thus timing signal duration, based upon the printing history of the print head. The optimal printing energy (timing signal duration) is plotted as a function of the energisation value, and shown by solid line O. A stepped reduction in timing signal duration, as described above, which includes a plurality of thresholds and a plurality of timing signal reductions, is shown by dash-dot line S. The stepped reduction allows the actual printing energy to be adjusted to approximate the optimal printing energy for each printing operation.

In the stepped approach, the timing signals are initially generated for 100% of their nominal duration. If the energisation values of a particular subset of printing elements exceed a threshold $T_1$ (e.g. 400), the timing signal duration is reduced to a first reduced timing signal duration $D_1$ (e.g. 95%). If the energisation values of a particular subset of printing elements exceed a second threshold $T_2$ (e.g. 650), the timing signal duration is reduced to a second reduced timing signal duration $D_2$ (e.g. 85%). As described above, there may be several further energisation value thresholds $T_3$, $T_4$, etc., and several further reduced timing signal durations $D_3$, $D_4$, etc.

In an alternative embodiment, rather than having distinct threshold values at which the duration of the timing signals is reduced by a step value, a gradual reduction in the duration of the time signals can be used. A gradual reduction in the duration of the timing signals allows more accurate control of the printing energy, and thus a closer approximation of the optimal printing energy O. A closer approximation of the optimal printing energy produces a more accurate control of darkness within a printed image.

A gradual reduction in timing signal duration is shown by dashed line G. Once the energisation value reaches a first reduction onset threshold $T_{R1}$, the timing signal duration is reduced at a predetermined rate $R_1$ for every additional increase in the energisation value E. For example, the duration of the timing signals may be reduced by a predetermined amount for each increase in the energisation value above the first reduction onset threshold $T_{R1}$.

Further, in some embodiments, once a second reduction onset threshold $T_{R2}$ has been exceeded, the timing duration is reduced at a second predetermined rate $R_2$. Where an energisation value is between first and second reduction onset threshold $T_{R1}$, $T_{R2}$, the timing duration may be calculated by interpolating between a first timing duration at the first reduction onset threshold $T_{R1}$ (such as, for example, 100%), and a second timing duration at the second reduction onset threshold $T_{R2}$ (such as, for example, 90%). It will be appreciated that there may be several further reduction onset thresholds $T_{R3}$, $T_{R4}$ etc., and several further corresponding predetermined rates $R_3$, $R_4$, etc. It will further be appreciated that any of the predetermined rates $R_1$-$R_4$ may have the same value.

In some embodiments there may be combination of a stepped reduction in printing energy and a gradual reduction in printing energy (i.e. in timing signal duration). For example a first timing signal duration (e.g. 100% of a nominal value) may be applied below a first energisation threshold (e.g. 50). When the energisation value is equal to the first energisation threshold, a first reduced timing signal duration (e.g. 90%) may be applied (i.e. there may be a step change at the first energisation threshold). Thereafter, the timing signal duration may be reduced gradually to a second reduced timing duration (e.g. 80%) when the energisation value is equal to a second energisation threshold (e.g. 150). That is, between the first and second energisation thresholds, the timing signal duration is reduced by an amount that is proportional to the difference between the energisation value and the first and second energisation thresholds. For example, if the energisation value is 70, which is 20% of the distance between the first and second energisation thresholds (which are 50 and 150 respectively), the timing duration is scaled to be 20% of the distance between the first reduced timing signal duration (90%) and the second reduced timing signal duration (80%), which results in a timing signal duration of 88% of the nominal timing signal duration. Once the energisation value of the subset of printing elements exceeds the second energisation threshold (e.g. 150), the timing signal duration remains at the second reduced timing signal duration (e.g. 80%).

The reduction of the duration of the timing signals, as described above, allows more accurate control of the printing energy delivered to each printing element. This may be particularly beneficial when printing long images such as, for example, barcodes. Where a stepped approach is used, immediately before a step is made (e.g. a step between $D_1$ and $D_2$), and immediately after a step has been made, there may be a significant difference between the optimal printing energy and the actual printing energy supplied. This difference is illustrated in FIG. 7 by the difference between the optimal printing energy (solid line O) and stepped reduction in printing energy (dash-dot line S). It can be seen that the gradual reduction in printing energy (dashed line G), can be more finely tuned to approximate the optimal printing energy (solid line O).

Each time the energisation value for each of the printing elements is updated (i.e. after each printing operation) the processing of FIG. 6 is carried out based upon the updated energisation values. As such, after each printing operation it is determined whether the energisation values of printing elements 11 in the spatially adjacent subset of printing elements 34 satisfy one of the thresholds and if this is the case the timing signals are appropriately modified for use in the next printing operation to print the image. The timing signals are therefore updated for each printing operation, if such updating is required by the current values of the energisation values. The processing of FIG. 6 may reset the timing signals to their maximum values for the first printing operation of a new image given that, as noted above, energisation values are reset for image to be printed such that none of the thresholds will be satisfied by the energisation values of the printing elements 11 in the predetermined subset of printing elements 34.

While only a single predetermined subset of printing elements 11 is shown in FIG. 6 it will be appreciated that a plurality of predetermined subsets may be similarly processed, each printing element belonging to at least one of the predetermined subsets of printing elements.

In some applications it may be desirable to limit the subsets of printing elements 34 which are used in the processing of FIG. 6. It will be appreciated from the preceding description that the processing of FIG. 6 is such that the subset of printing elements 34 exceeding the highest threshold determines the reduction to be applied to the generated timing signals. This may have the effect of causing printing elements 11 in some parts of the print head to be insufficiently heated during subsequent printing operations. Where a particular part of the image is particularly important it may be desirable to ensure that only printing elements 11 which correspond to the particularly important part of the printed image are used in the determination of FIG. 6 as to whether energisation times should be reduced. An example of such a particularly important part of a printed image is a barcode given the need to ensure good quality printing so as to ensure that the barcode can be properly read.

It can be appreciated from FIG. 6 and its associated description that the energisation values are generally processed so as to determine whether all energisation values for printing elements in a small localised part of the printhead exceed some threshold. If this is the case, the energisation times (indicated by the timing signals 17', 18', 19', 20', 21') are reduced. This is because the cumulative effect of a plurality of spatially adjacent printing elements exceeding the threshold will likely lead the printing elements to overheat. This is important not only because of the heating effect of one printing element on nearby printing elements but also because a plurality of overheating printing elements in a localised area is more likely to cause image defects which are apparent to a human observer, while overheating (and consequent printing degradation caused by a single printing element is less likely to cause defects which are discernible by a human being).

The processing of FIG. 6 may be modified such that only a single threshold is applied to the energisation values so as to allow only a single reduction in the duration of the timing signals 17', 18', 19', 20', 21'.

The preceding description has discussed reducing the energisation times where energisation values for all printing elements in the predetermined subset exceed some threshold. It will be appreciated, however, that in alternative embodiments the energisation times (indicated by the durations of the timing signals 17', 18', 19', 20', 21') may be reduced if the collective energisation values exceed a threshold or if a predetermined proportion of printing elements in the predetermined subset each exceed some threshold.

It will further be appreciated that in some embodiments the energisation times may be reduced if the energisation value of a single printing element in the predetermined subset of printing elements exceeds a threshold (i.e. the threshold is applied to the maximum energisation value within the predetermined subset of printing elements). This results in a reduction in printing energy being applied based upon the printing elements which are at most risk of overheating.

It will further be appreciated that in some embodiments different reductions may be applied to the durations of different ones of the timing signals 17', 18', 19', 20', 21'. Furthermore, different thresholds may be applied to the energisation values at which durations of different ones of the timing signals 17', 18', 19', 20', 21' are adjusted.

The energy values used in determination of the energisation values may be varied as processing proceeds depending upon a current relationship between the energisation values and one or more thresholds.

It has been described with reference to FIGS. 4A to 4E that the printing element controllers 15 control a time for which each printing element is energised based upon energisations in two immediately preceding printing operations. It has been described with reference to FIGS. 5 and 6 that energisation values are maintained over the length of a printed image, and that these energisation values are used by the printer controller 10 to control the durations of the timing signals which are provided to the printhead 7 from which the printing element controllers 15 can select. As such, the processing performed by the printer controller 10 operates over a longer time period than the processing performed by the printing element controllers 15. Additionally, the printer controller 10 may monitor the overall temperature of the printhead 7 (using a temperature probe) and adjust the durations of the timing signals 17', 18', 19', 20', 21' based upon this temperature monitoring. The control based upon this monitoring of printhead temperature is generally carried out over a longer time period than either of the controls described above. As such, three control schemes are provided over three distinct time periods.

Figure 8:
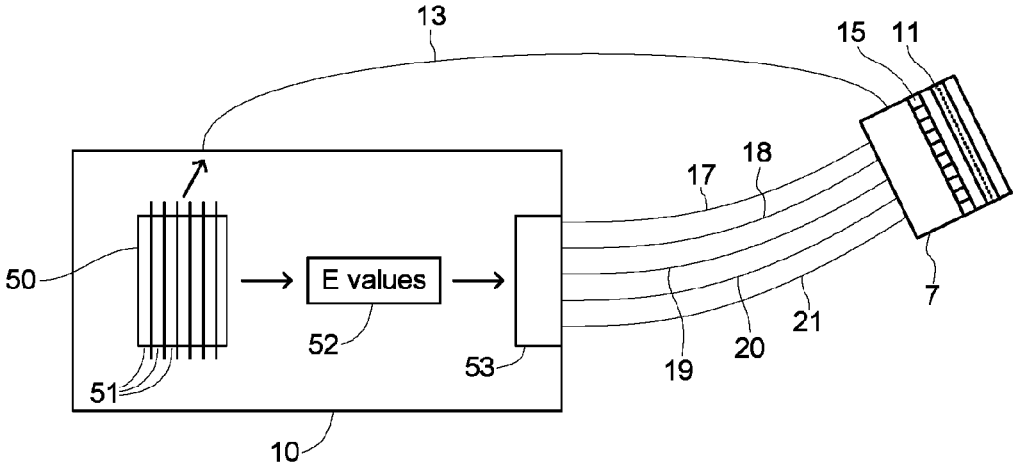
FIG. 8 is a schematic illustration of an overall control printing element control scheme used in the printer of FIG. 1.

Referring now to FIG. 8, an overall control methodology used in the printer of FIG. 1 is described. Image data 50 is processed by the printer controller 10. The image data is divided into lines 51 each line having a printed resolution of 1 pixel width. The lines of image data 51 are provided from the printer controller 10 to the printhead 7 along the data line 13.

Each line of image data 51 is also processed by an energisation value calculator block 52 which maintains energisation values for each of the printing elements. The energisation values generated by the energisation value calculator block 52 are passed to a time determination block 53 which determines the lengths of timing signals 17', 18', 19', 20' and 21' respectively provided to the printhead 7 on timing lines 17, 18, 19, 20 and 21. The timing signals 17', 18', 19', 20' and 21' are then selected by the printing element controllers 15 in the manner described above.

In this way, the printer controller 10 and the printhead 7 work together to determine energisation times for each of the printing elements, the printer controller 10 working to reduce the energisation times which may be selected by the printhead 7 where spatially adjacent printing elements all have energisation values which indicate that overheating of the printing elements is likely.

It will be appreciated that while one method of printing element energisation control by printing element controller 15 is described above other methods are possible. For example, the printing element controller 15 may select from a larger or smaller number of timing signals than the five signals (17', 18', 19', 20', 21') described above with reference to FIG. 3. Where a printhead requires a larger number of timing signals, the printer controller 10 can generate these timing signals as appropriate. Alternatively, such timing signals can be generated internally within the printhead, based upon data internal to or external of the printhead.

Furthermore, the printing element controller 15 may select from a number of timing signals based upon the energisations of more than two previous printing operations (e.g. printing element control may be based upon printing operations $P_{n-1}$, $P_{n-2}$, and $P_{n-3}$, where printing operation $P_{n-3}$ is the printing operation immediately before printing operation $P_{n-2}$).

In embodiments of the invention a further timing signal may be used which causes a printing element 11 to be energised for an additional length of time in dependence upon the energisation of a subsequent printing operation (i.e. energisation of the printing element 11 in the printing operation $P_{n+1}$, where printing operation $P_{n+1}$ is the printing operation after the current printing operation). This allows the printing element 11 to be pre-heated for the subsequent printing operation $P_{n+1}$.

Reference has been made in the preceding description to continuous timing signals (as shown in FIG. 3). It will be appreciated that in alternative implementations pulsed controlled signals may be used where the total duration of a plurality of pulses cause energisation of the printing elements for a particular desired time. Where the timing signals are modified by processing similar to that of FIG. 6, the duration of each pulse may be modified.

Reference has been made in the preceding description to the printer controller 10 and various functions have been attributed to the printer controller 10. It will be appreciated that the printer controller 10 can be implemented in any convenient way including as an application specific integrated circuit (ASIC), field programmable gate array (FPGA) or a microprocessor connected to a memory storing processor readable instructions, the instructions being arranged to control the printer and the microprocessor being arranged to read and execute the instructions stored in the memory. Furthermore, it will be appreciated that in some embodiments the printer controller 10 may be provided by a plurality of controller devices each of which is charged with carrying out some of the control functions attributed to the printer controller 10.

In an alternative printing technique, a ribbon may be omitted. Rather than transferring ink onto a substrate to be printed upon, a thermal paper may be used as the target surface. Thermal paper will change color when exposed to a heat source. A printhead, such as that described above, may be caused to come into contact directly with the thermal paper, a region of paper changing color where a printing element was heated. Any techniques described with reference to a thermal transfer printer may therefore also be used to control a printhead in a thermal printer or in any form of printer in which a thermal printing element is used.

While various embodiments have been described above it will be appreciated that these embodiments are for all purposes exemplary, not limiting. Various modifications can be made to the described embodiments without departing from the spirit and scope of the present invention.

The invention claimed is:

1. A method for controlling a thermal printhead of a printer, the printhead comprising an array of printing elements, the method comprising:

performing a plurality of printing operations, each printing operation comprising energisation of one or more printing elements;

determining, for each printing element, a respective energisation value based at least in part upon whether or not that printing element was energized during said printing operations;

generating a printhead control signal for the printhead for a subsequent printing operation based upon the energisation values of a predetermined subset of the printing elements;

wherein the printhead control signal affects energisation of a plurality of printing elements across the entire printhead in the subsequent printing operation in a way that is the same for each of the plurality of printing elements.

2. A method according to claim 1, wherein the predetermined subset of the printing elements is a subset of spatially adjacent printing elements.

3. A method according to claim 1, wherein generating the printhead control signal comprises generating a first printhead control signal if said energisation values of the predetermined subset of printing elements satisfy a predetermined criterion and generating a second printhead control signal if said predetermined subset of printing elements do not satisfy the predetermined criterion.

4. A method according to claim 1, wherein said printhead control signal affects energy dissipated by the plurality of printing elements in the subsequent printing operation.

5. A method according to claim 1, wherein generating the printhead control signal comprises generating one or more timing signals controlling one or more times for which printing elements are energised in said subsequent printing operation.

6. A method according to claim 1, wherein determining an energisation value for a respective one of said printing elements comprises summing a plurality of energy values, each energy value being associated with one of said plurality of printing operations.

7. A method according to claim 1, wherein the method is carried out at a printer controller external of the printhead.

8. A method according to claim 7, wherein the printhead comprises a printhead controller and wherein the method further comprises, at the printhead controller, for each of a plurality of printing elements to be energised, determining a printing element control signal based upon energisation of one or more printing elements in a printing operation which precedes the subsequent printing operation.

9. A method according to claim 8, wherein said printing element control signal for a respective printing element is determined based upon energisation of the respective printing element in one or more preceding printing operations.

10. A method according to claim 9, wherein said printing element control signal for a respective printing element is further determined based upon energisation of one or more spatially adjacent printing elements in one or more preceding printing operations.

11. A method according to claim 8, wherein determining a printing element control signal comprises determining a time for which the printing element is to be energised in the subsequent printing operation.

12. A method according to claim 11, wherein determining the time for which the printing element is to be energised in the subsequent printing operation comprises selecting one of a plurality of times for which the printing element should be energised in the subsequent printing operation.

13. A method according to claim 12, wherein said plurality of times are specified by said printhead control signal.

14. A method according to claim 1, wherein generating the printhead control signal based upon the energisation values of the predetermined subset of printing elements comprises:

obtaining first data indicating a relationship between a first energisation value and a first printhead control signal;

processing said first data and said energisation values of the predetermined subset of printing elements to generate said printhead control signal.

15. A method according to claim 14, further comprising obtaining second data indicating a relationship between a second energisation value and a second printhead control signal;

wherein processing said first data and said energisation values of the predetermined subset of printing elements comprises processing said second data such that said generated printhead control signal is based upon said first data and said second data.

16. A method according to claim 15, wherein said processing said first data, said second data and said energisation values of the predetermined subset of printing elements comprises:

determining a relationship between said first energisation value, said second energisation value and said energisation values of the predetermined subset of printing elements; and generating said printhead control signal based upon said first printhead control signal and the second printhead control signal according to the determined relationship.

17. A method according to claim 1, wherein generating a printhead control signal based upon the energisation values of a predetermined subset of the printing elements comprises:

determining a difference between the energisation values of the predetermined subset of the printing elements and a threshold value; and generating the printhead control signal based upon said determined difference.

18. A thermal printer controller comprising circuitry arranged to control a thermal printhead of a thermal printer, the printhead comprising an array of printing elements, the circuitry being arranged to control the thermal printer to carry out the operations of:

performing a plurality of printing operations, each printing operation comprising energisation of one or more printing elements;

determining, for each printing element, a respective energisation value based at least in part upon whether or not that printing element was energized during said printing operations;

generating a printhead control signal for the printhead for a subsequent printing operation based upon the energisation values of a predetermined subset of the printing elements;

wherein the printhead control signal affects energisation of a plurality of printing elements across the printhead in the subsequent printing operation in a way that is the same for each of the plurality of printing elements.

19. A thermal printer controller according to claim 18, wherein the circuitry comprises a memory storing processor readable instructions and a processor configured to read and execute instructions stored in said memory.

20. A thermal transfer printer comprising:

first and second spool supports each being configured to support a spool of ribbon; and a ribbon drive configured to cause movement of ribbon from the first spool support to the second spool support;

a printhead configured to selectively transfer ink from the ribbon to a substrate, a controller according to claim 18.

* * * * *